US006705203B2

(12) United States Patent
Boone

(10) Patent No.: US 6,705,203 B2
(45) Date of Patent: Mar. 16, 2004

(54) EXTENDED MALE SLIPPER SERVO PAD ARRANGEMENT FOR POSITIONING SWASHPLATE AND METHOD ASSEMBLING SAME

(75) Inventor: Nick Boone, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 307 days.

(21) Appl. No.: 09/996,503

(22) Filed: Nov. 28, 2001

(65) Prior Publication Data

US 2003/0097927 A1 May 29, 2003

(51) Int. Cl.[7] ..... F01B 3/00

(52) U.S. Cl. ..... 92/71; 92/12.2; 92/129; 91/505; 29/888.02; 29/281.5

(58) Field of Search ..... 92/71, 129, 153, 92/12.2; 91/505; 29/888.02, 281.5

(56) References Cited

U.S. PATENT DOCUMENTS 3,130,540 A * 4/1964 Manning et al. ..... 60/327
3,289,605 A * 12/1966 Funk et al. ..... 91/486
3,384,027 A * 5/1968 Jennings et al. ..... 60/415
3,722,370 A 3/1973 Aplin
3,727,521 A 4/1973 Reynolds
4,142,452 A * 3/1979 Forster et al. ..... 91/506
4,515,067 A 5/1985 Heyl
4,615,257 A 10/1986 Valentin
4,893,548 A 1/1990 Kawahara et al.
5,094,145 A * 3/1992 Wakabayashi et al. ..... 91/486
5,490,446 A 2/1996 Engel

* cited by examiner

*Primary Examiner*—Thomas Denion
*Assistant Examiner*—Igor Kershteyn

(57) ABSTRACT

An extended male slipper servo pad provides an improved connection between the swashplate and a positioning mechanism in a variable displacement hydraulic unit. The swashplate assembly includes a swashplate having a socket formed therein and a male slipper servo pad pivotally attached to the swashplate at the socket. The male slipper servo pad has a ball end secured in the socket and a pad end having a substantially flat planar surface thereon directed away from the ball end.

20 Claims, 6 Drawing Sheets

EXTENDED MALE SLIPPER SERVO PAD ARRANGEMENT FOR POSITIONING SWASHPLATE AND METHOD ASSEMBLING SAME

BACKGROUND OF THE INVENTION

The present invention relates to the field of variable displacement hydraulic units, such as hydrostatic pumps and motors. More particularly, this invention relates to an extended male slipper servo pad pivotally mounted to the swashplate of such units so as to provide sliding surface area contact with the positioning mechanism. The invention results in a unique swashplate assembly that has few parts and is economical to produce.

Various arrangements are known for connecting the swashplate of a variable displacement hydraulic unit, such as a pump or motor, to a positioning means or mechanism such as a servo piston or a bias piston. In one such arrangement a cammed button is press fitted into the swashplate. This provides a sliding line contact on the servo piston or bias piston. A second arrangement involves a domed servo piston or bias piston running against the swashplate. This provides a sliding point contact. Pin and link connections have also been tried. Another known arrangement involves attaching a female slipper to a male piston in a crimping or swedging operation. The male piston end of this piston-slipper assembly is then pressed into a cylindrical hole in the swashplate. With this arrangement, multiple operations are required to provide a swashplate assembly that is ready for connection with the positioning mechanism. Therefore, there is a need for an improved connection of the swashplate to the positioning mechanism in a variable displacement hydraulic unit.

A primary objective of the present invention is the provision of an improved connection between the swashplate and swashplate positioning mechanism of a variable displacement hydraulic unit.

Another objective of the present invention is the provision of an extended male slipper having a ball end pivotally attached to the swashplate and a pad end adapted to provide surface area contact with the positioning mechanism.

A further objective of the present invention is the provision of a connection between the swashplate and the swashplate positioning mechanism that is economical to produce and reliable in use.

These and other objectives will be apparent from the drawings, as well as from the description and claims that follow.

BRIEF SUMMARY OF THE INVENTION

The present invention relates to an extended male slipper servo pad pivotally mounted to the swashplate of variable displacement hydraulic units so as to provide sliding surface area contact with the swashplate positioning mechanism. The extended male slipper servo pad is pivotally secured in a socket formed in the swashplate. The slipper servo pad has a substantially spherical ball end with a major diameter disposed in the socket, an elongated neck portion, and a pad end having a substantially flat planar surface thereon directed away from the ball end. The substantially flat planar surface of the pad end provides surface area contact with a mating planar surface on the swashplate positioning means, which can include a servo piston and/or a biased piston.

In the first embodiment of the invention, the swashplate socket has a reduced diameter portion adjacent the entrance of the socket and an enlarged diameter portion adjacent to the reduced diameter portion so as to form a shoulder therebetween for retaining the ball end of the slipper servo pad, which can be press fitted into the socket. In another embodiment, a sleeve or bushing having a malleable ramped skirt portion is interposed between the ball end of the male slipper servo pad and the socket during installation. The ramped skirt portion, which has an outer diameter slightly greater than the diameter of the socket, bends or deforms inwardly to automatically crimp the sleeve on the ball end of the slipper servo pad and retain the same in the socket. Both embodiments provide quick and easy ways to connect the swashplate with a piston member of a positioning mechanism.

DETAILED DESCRIPTION OF THE INVENTION

Figure 1:
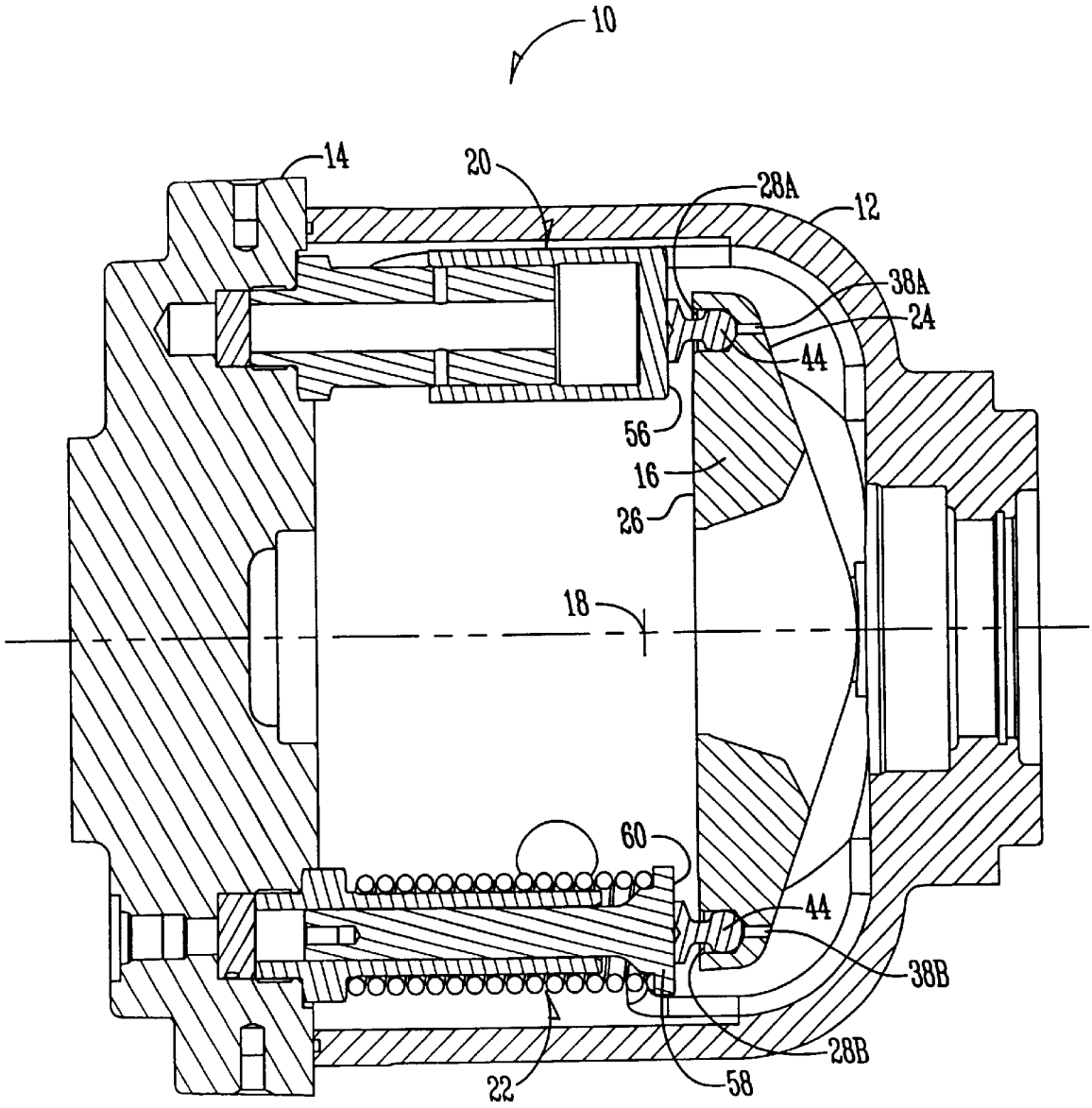
FIG. 1 is a cross-sectional view of portions of a hydraulic unit equipped with the present invention in a zero displacement position.

In the drawings and the description that follows, similar components are designated with similar reference numerals. Portions of a variable displacement axial piston unit, 10 constructed according to the present invention are shown in FIG. 1. Although the invention is shown and described as being applied to a variable displacement open circuit pump, one skilled in the art will appreciate that the invention is applicable to variable displacement hydraulic motors. The invention is also applicable to closed circuit pumps or motors.

The hydraulic unit 10 has a housing 12 and an end cap 14 detachably mounted thereto by conventional fasteners (not shown). The major rotating components of the hydraulic unit 10 are conventional and are not particularly relevant to the invention. Thus, the following conventional components have been omitted from the drawings to simplify them: a shaft, a cylinder block assembly including a cylinder block housing a plurality of axially reciprocating pistons, and a valve plate for controlling the flow of the working fluid. The fluid displacement or consumption of the hydraulic unit 10 is determined or controlled by a swashplate 16 that movably mounts in the housing 12 so as to pivot along a tilt axis 18 in a well known conventional manner. Positioning means forcibly position or pivot the swashplate 16 about the tilt axis 18. Generally, the positioning means includes one or more hydraulically operated servo pistons 20. In the examples shown in the drawings and described below, the positioning means includes a servo piston 20 and a spring-loaded bias piston 22. The bias piston 22 urges the swashplate 16 to pivot to its maximum angle and the servo piston 20 located on the opposite side of the tilt axis 18 destrokes the open circuit pump to modulate its displacement.

The swashplate 16 has a bottom surface 24 that is generally directed toward the bottom of the housing 12 and a substantially planar top surface 26 that is generally directed toward the end cap 14. A substantially cylindrical socket 28A extends into the swashplate 16, preferably perpendicularly from its top surface 26. The socket 28A registers with the servo piston 20. A second socket 28B registers with the bias piston 22. Since sockets 28A and 28B are preferably identical, only socket 28A is described in detail below.

Figure 3:
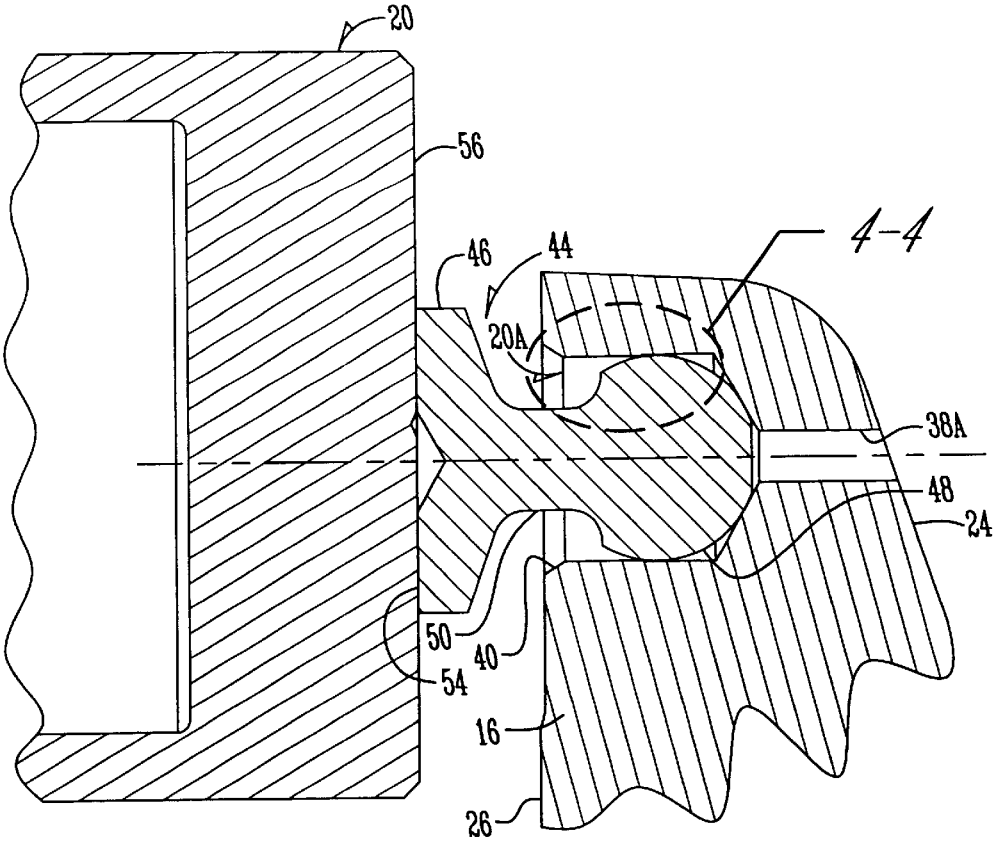
FIG. 3 is an enlarged cross-sectional view that shows in greater detail the extended male slipper servo pad arrangement of this invention for positioning the swashplate. The slipper servo pad provides surface area contact with the servo piston.
Figure 4:
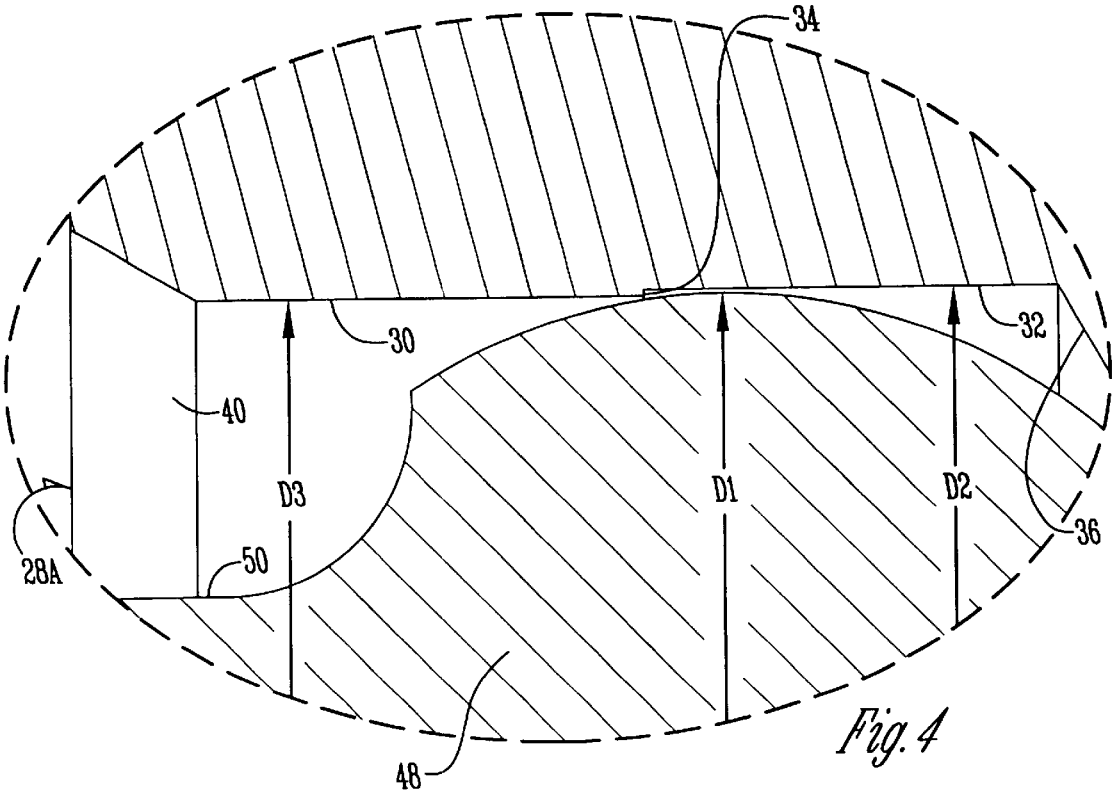
FIG. 4 is an enlarged cross-sectional view of the area 4—4 in FIG. 3 and shows in even greater detail the means and method for pivotally attaching the male slipper servo pad to the swashplate.
Figure 5:
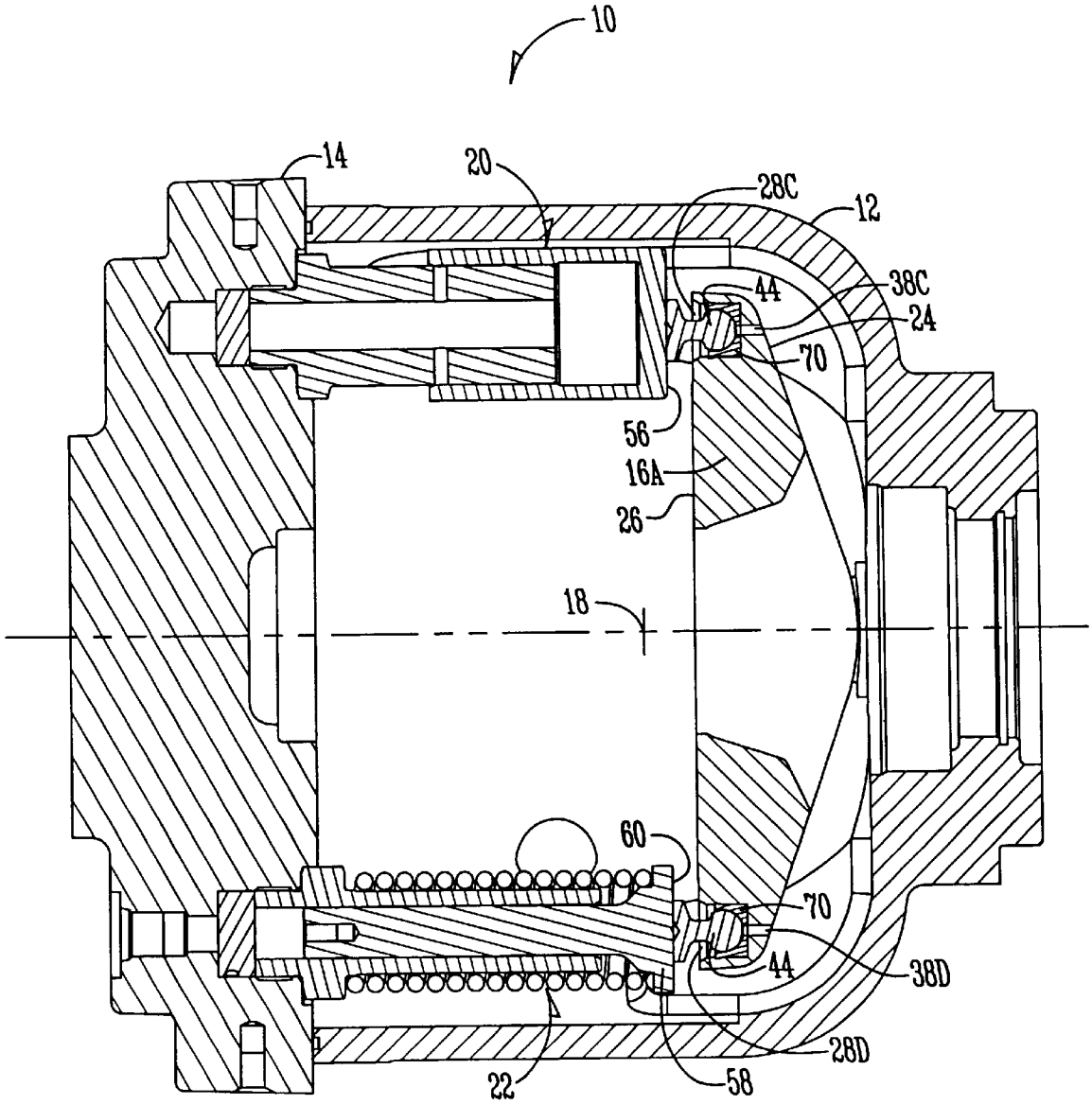
FIG. 5 is a cross-sectional view similar to FIG. 1 but shows another embodiment of this invention.

As best seen in FIGS. 3 and 4, the socket 28A has a reduced diameter portion 30 adjacent its entrance. An enlarged diameter portion 32 resides inwardly adjacent the reduced diameter portion 30, so that a shoulder 34 resides therebetween. The bottom wall 36 of the socket 28 preferably is a frustoconical surface having an included angle of approximately 60 degrees. This is approximately the same angle as the point on a standard drill bit. A fluid passageway 38 extends into the socket 28A from the bottom surface 24 of the swashplate 16. The entrance of the socket 28A at the top surface 26 of the swashplate 16 preferably has a lead-in chamfer 40 formed thereon. The chamfer 40 preferably forms an angle of approximately 30 to 60 degrees, and more preferably approximately 45 degrees, with respect to a central longitudinal axis 42 of the socket 28. Preferably the socket 28A is perpendicular to the top surface 26 of the swashplate 16. The socket 28A is offset from the tilt axis 18 of the swashplate 16.

The socket 28A or 28B constitutes one element of the unique means and methods for connecting the positioning means to the swashplate 16 in this invention. The other element is a male slipper servo pad 44 (hereinafter "slipper"). The slipper 44 has a pad end 46 and a generally spherical ball end 48 connected by an intermediate elongated neck portion 50. The slipper 44 has a central longitudinal axis 52. The ball end 48 of the slipper 44 has a major diameter D1 in a plane perpendicular to the central longitudinal axis 52. The ball end 48 of the slipper 44 has an undercut radius at its trailing end, which blends into the intermediate neck portion 50. The pad end 46 is preferably a circular or annular disk that has an outside diameter larger than the diameter D1 of the ball end 48. The pad end 46 has a substantially planar surface 54 thereon that engages the substantially planar forward surface 56 of the servo piston 20. Thus, the positioning force transmitted by the servo piston 20 on the swashplate 16 is advantageously distributed over a substantial surface area of contact.

The enlarged diameter portion 32 of the socket 28A has a diameter D2 that is greater than the major diameter D1 of the ball end 48 of the male slipper 44. On the other hand, the reduced diameter portion 30 of the socket 28A has a diameter D3 that is slightly smaller than the major diameter D1 of the ball end 48.

To pivotally attach the slipper 44 to the swashplate 16, the assembler positions the slipper 44 with its ball end 48 at the entrance of the socket 28A. The chamfer 40 provides guidance into the socket 28A. Then an axial force is applied to the pad end 46 of the slipper 44 to push the ball end 48 through the reduced diameter portion 30 of the socket 28A. Once the major diameter D1 is forward of the shoulder 34 and disposed in the enlarged diameter portion 32 of the socket 28A, the shoulder 34 retains the ball end 48 of the slipper 44 in the socket 28A and the pad end 46 is free to pivot about the central longitudinal axis 52. The sizes of the diameters D2 and D3 can be adjusted relative to the diameter D1 of the ball end 48 so as to arrive at a reasonable press-in force and a desired pull-off strength for the joint. For example, the following dimensions have been found to work well in a 100 cc per revolution open circuit pump:

D1=12.137 mm;

D2=12.23 mm; and

D3=12.1 mm.

Figure 2:
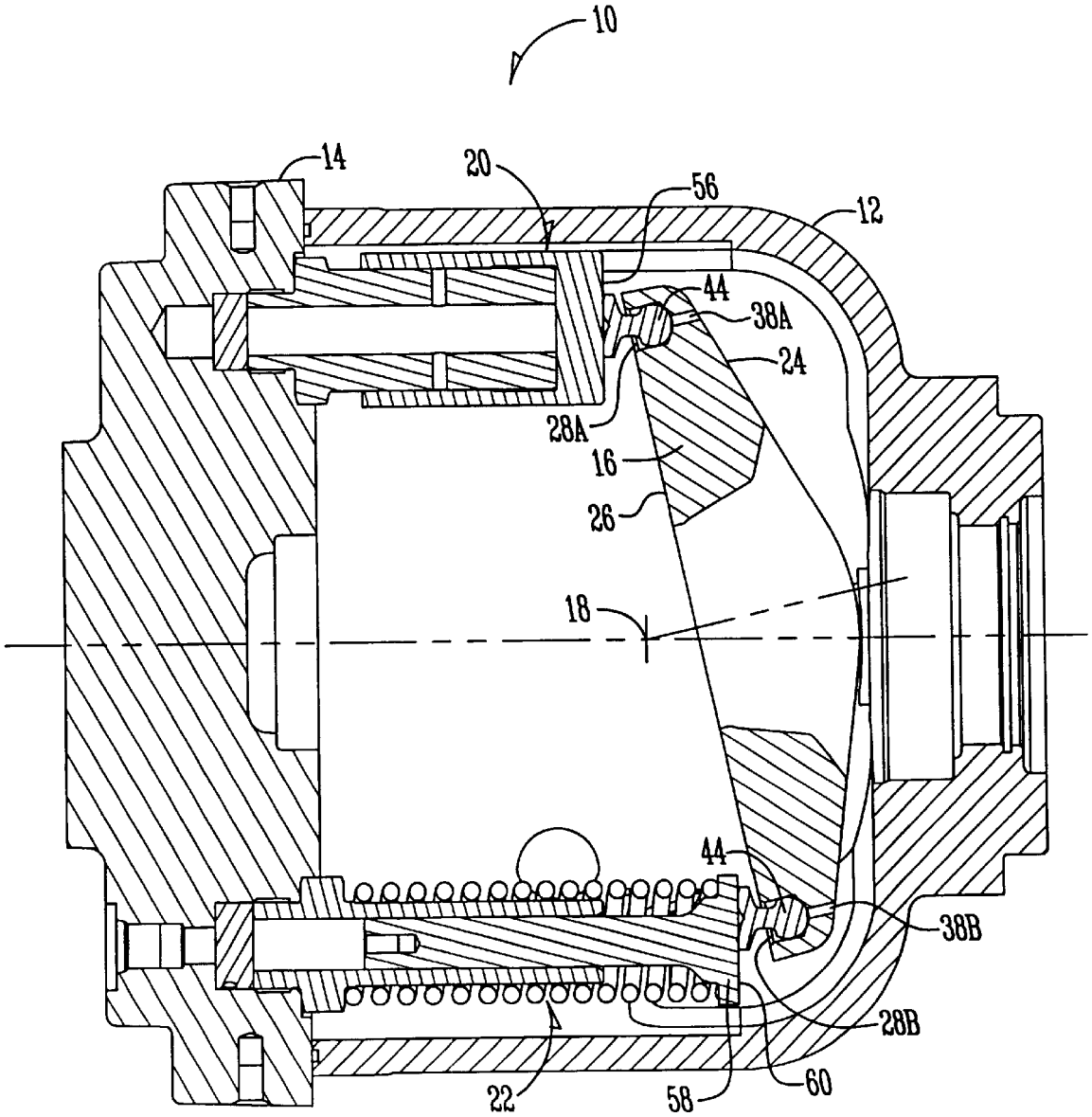
FIG. 2 is a cross-sectional view similar to FIG. 1, but shows the swashplate pivoted to its maximum displacement or full stroke position.

A second socket 28B and slipper 44 are provided on the opposite side of the tilt axis 18 adjacent the piston member 58 of the bias piston 22. A passageway 38B intersects the socket 28B. The surface 54 on the slipper 44 engages the substantially planar surface 60 on the bias piston 22, as best seen in FIG. 2. Again, surface area contact is provided between the piston 22 and the slipper pad end 46.

Figure 6:
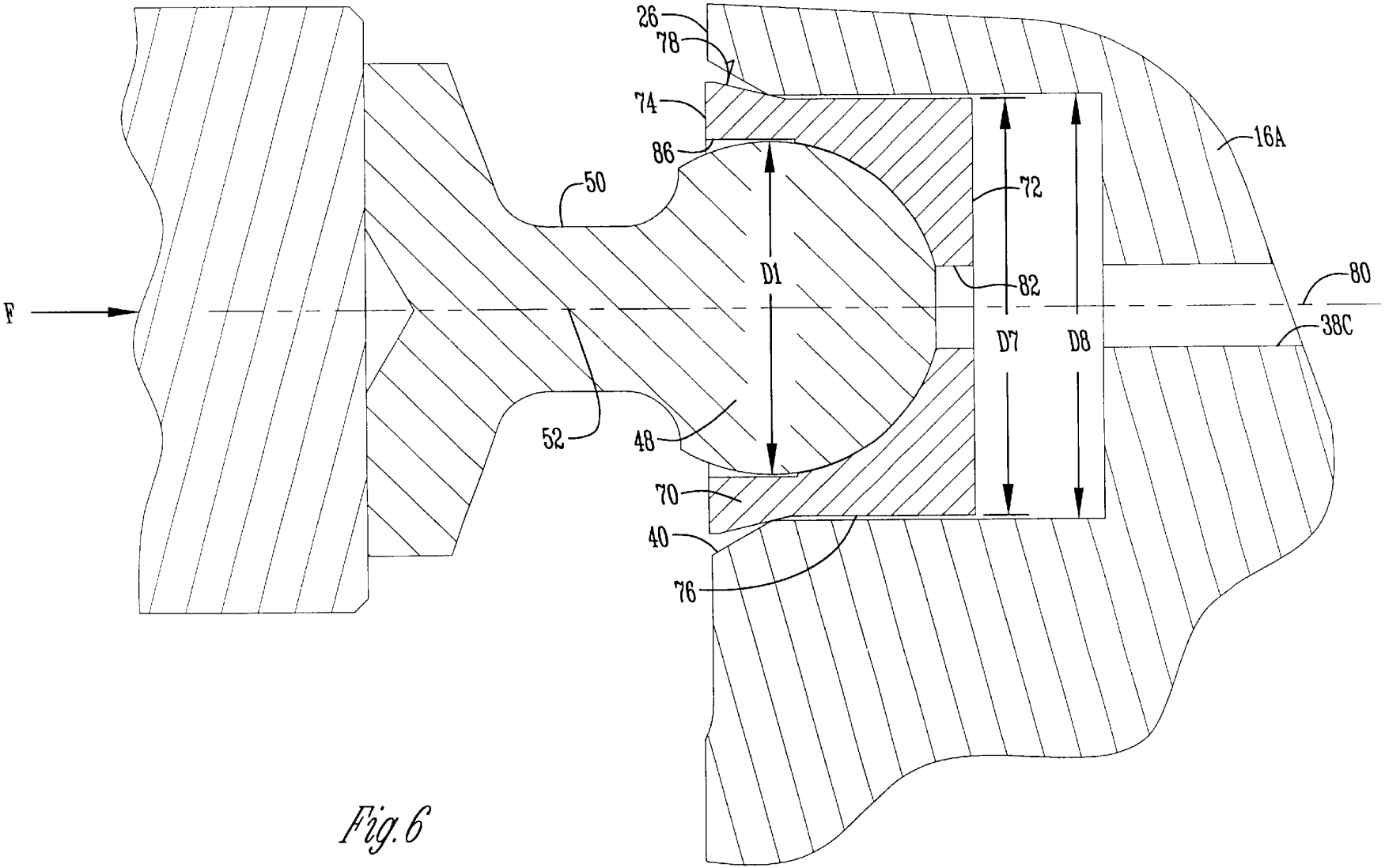
FIG. 6 is an enlarged cross-sectional view illustrating how the self-crimping bushing receives the male slipper servo pad and is automatically crimped thereonto as the bushing is driven into the swashplate socket by the slipper servo pad.
Figure 7:
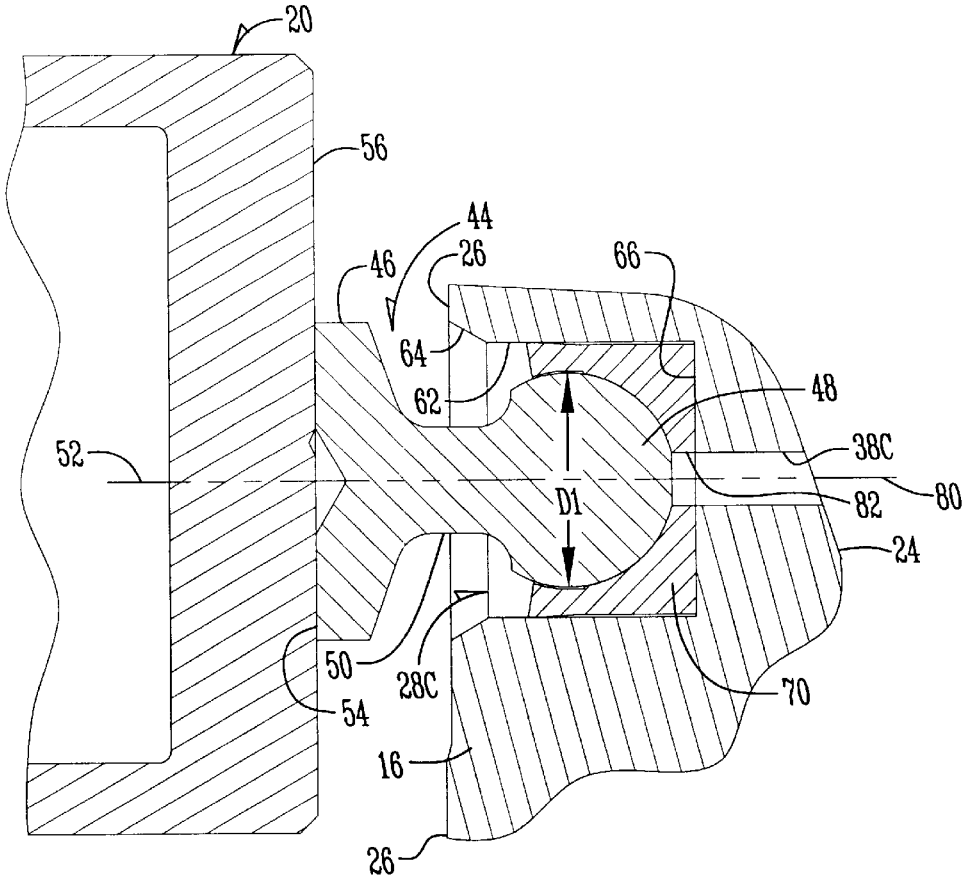
FIG. 7 is a cross-sectional view that shows the male slipper servo pad pivotally attached to the swashplate by the self-crimping bushing. The slipper servo pad provides substantial surface area contact with the servo piston.

FIGS. 5–8 illustrate another embodiment of this invention. In this embodiment, the swashplate 16 has one or more sockets 28C, 28D formed therein. Fluid passageways 38C, 38D extend from the bottom surface 24 of the swashplate 16A so as to be in fluid communication with the sockets 28C, 28D respectively. Since the sockets 28C and 28D are identical except for their location on the swashplate 16A, only the first socket 28C will be described in detail below. As best seen in FIGS. 6 and 7, the socket 28C has a substantially cylindrical shape. A main diameter portion 62 extends inwardly from the top face 26 of the swashplate 16A. The main diameter portion 62 has a diameter D8. The entrance of the socket 28C has a lead-in chamfer 64 thereon. The chamfer 64 has an included angle of approximately 60 degrees to 120 degrees, more preferably approximately 60 degrees to 90 degrees. The main diameter portion 62 terminates in a bottom wall 66.

Figure 8:
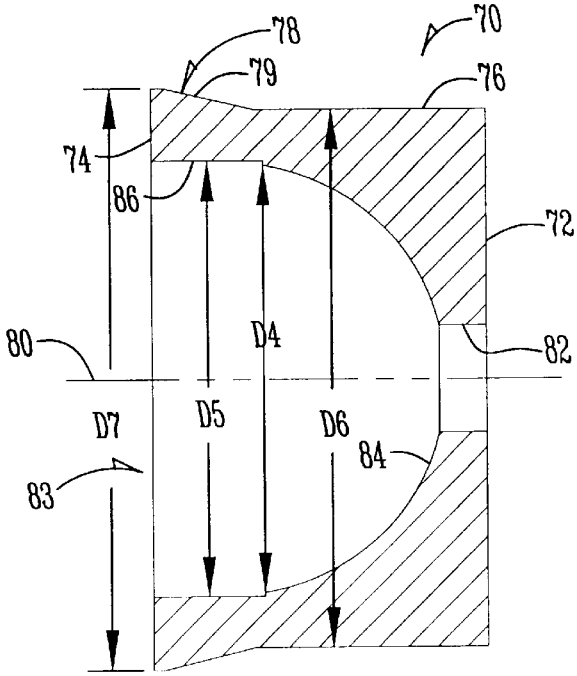
FIG. 8 is a cross-sectional view of the self-crimping bushing of the embodiment of FIG. 5.

Referring to FIG. 8, this embodiment includes a bushing or sleeve 70 formed of a suitably malleable material, including but not limited to brass. The bushing 70 has a first end 72 and a second end 74. The bushing 70 includes a main diameter portion 76 generally adjacent the first end 72 and a ramped skirt portion 78 generally adjacent the second end 74. The bushing 70 has a central longitudinal axis 80 and a fluid passageway 82 that extends through the bushing 70 along its central longitudinal axis 80. A cavity 83 for receiving the ball end 48 of the male slipper 44 extends into the second end 74 of the bushing 70. The cavity 83 includes a semi-spherical concave hollow 84 and a counterbore 86. The semi-spherical hollow has a diameter D4, while the counterbore 86 has a diameter D5. The main diameter portion 76 of the bushing 70 is designated by reference numeral D6. The ramped skirt 78 has an outer diameter designated by the reference numeral D7.

The use of the bushing 70 to pivotally attach the male slipper 44 to the swashplate 16A can best be understood in view of FIGS. 6–8. The ball end 48 of the slipper 44 is loosely inserted into the cavity 83 of the bushing 70. This loose subassembly is then positioned at the entrance of the socket 28C. An axial force F is applied to the pad end 46 of the slipper 44 to press the subassembly into the socket 28C. The lead-in chamfer 64 assists in guiding the bushing 70 into the main diameter portion 62 of the socket 28C. The diameter D8 of the main diameter portion 62 is large enough to slidably receive the diameter D6 of the bushing 70. However, once the major diameter D1 of the ball end of the slipper 44 passes the lead-in chamfer 64, the main diameter D8 engages the ramped skirt portion 78 of the malleable bushing 70. Thus, the malleable ramped skirt portion 78 is automatically crimped, deformed, or bent inwardly around the back of the ball end 48 of the slipper 44 as the subassembly is pressed into the socket 28C. The ramped skirt portion 78 also provides a light press fit between the subassembly and the socket 28C.

The ramped skirt portion 78 has a substantially frustoconical leading edge 79. The ramped skirt portion 78 extends outwardly at an angle of approximately 15 to 45 degrees, more preferably approximately 20 to 30 degrees, and most preferably approximately 25 degrees, with respect to the main diameter portion 76. Although the entire bushing 70 is malleable in the preferred embodiment described, one skilled in the art would appreciate that only the skirt portion 78 needs to be malleable.

Thus, it can be seen that the present invention at least achieves its stated objectives.

In the drawings and specifications, there has been set forth a preferred embodiment invention, and although specific terms are employed, these are used in a generic and descriptive sense only and not for purposes of limitation. Changes in the form and proportion of parts as well as in the substitution of equivalents are contemplated as circumstances may suggest or render expedient without departing from the scope of the invention as defined in the following claims.

What is claimed is:

1. A swashplate assembly for a variable displacement hydraulic unit comprising:

a swashplate having a socket formed therein; and a male slipper servo pad pivotally and swivelingly attached to the swashplate at the socket, the slipper servo pad having a substantially spherical ball end with a major diameter disposed in the socket of the swashplate, an elongated neck portion with a diameter less than the major diameter of the ball end, and a pad end having a substantially flat planar surface thereon directed away from the ball end.

2. The swashplate assembly of claim 1 wherein the planar surface on the pad end is a lower end of a circular disk that has an outer diameter greater than the major diameter of the ball end.

3. The swashplate assembly of claim 2 wherein the planar surface on the pad end is annular and has an inner diameter less than the major diameter of the ball end.

4. The swashplate assembly of claim 1 wherein the socket has a reduced diameter portion adjacent an entrance of the socket and an enlarged diameter portion inwardly adjacent to the reduced diameter portion so as to form a retention shoulder therebetween, the reduced diameter portion having a diameter slightly less than the major diameter of the ball end of the male slipper servo pad and the enlarged diameter portion having a diameter greater than the major diameter of the ball end of the male slipper servo pad such that the ball end is pivotally and swivelingly secured in the socket upon pressing the ball end into the socket through the reduced diameter portion until the major diameter passes the shoulder and resides in the enlarged diameter portion of the socket.

5. The swashplate assembly of claim 4 wherein the enlarged diameter portion of the socket terminates in a frustoconical bottom wall.

6. The swashplate assembly of claim 1 wherein the socket has a given diameter larger than the major diameter of the ball end of the male slipper servo pad and the assembly further comprises a sleeve having a cavity therein for receiving the ball end of the male slipper servo pad and a main outer diameter portion slidably insertable into the given diameter of the socket, the sleeve including a malleable skirt portion ramped rearwardly and outwardly with respect to the main outer diameter portion, the skirt portion having an outer diameter greater than the given diameter of the socket such that the skirt portion press fits into the given diameter of the socket and thereby deforms inwardly or crimps around the ball end of the male slipper servo pad.

7. The swashplate assembly of claim 6 wherein the entire sleeve is formed of a malleable material.

8. The swashplate assembly of claim 7 wherein the malleable material is brass.

9. The swashplate assembly of claim 6 wherein the ramped skirt portion includes a frustoconical surface.

10. The swashplate assembly of claim 6 wherein the ramped skirt portion extends at an angle of approximately 15 to 45 degrees with respect to the main outer diameter portion.

11. The swashplate assembly of claim 10 wherein the ramped skirt portion extends at an angle of approximately 20 to 30 degrees with respect to the main outer diameter portion.

12. The swashplate assembly of claim 11 wherein the ramped skirt portion extends at an angle of approximately 25 degrees with respect to the main outer diameter portion.

13. A variable displacement hydrostatic power unit comprising:

a housing;

a swashplate movably mounted in the housing so as to be pivotal about a tilt axis for controlling fluid displacement of the unit;

the swashplate having a first socket formed therein offset from the tilt axis, the first socket having a reduced diameter portion adjacent an entrance of the socket and an enlarged diameter portion inwardly adjacent to the reduced diameter portion so as to form a shoulder therebetween;

positioning means for pivotally positioning the swashplate;

a first male slipper for connecting the positioning means to the swashplate, the slipper having a pad end for providing sliding planar surface area contact with the positioning means and a substantially spherical ball end having a major diameter thereon for pivotally engaging the swashplate, the major diameter being greater than the diameter of the reduced diameter portion and less than the diameter of the enlarged diameter portion;

the ball end of the slipper being forcibly inserted past the reduced diameter portion and the shoulder of the first socket and into the enlarged diameter portion so as to pivotally secure the slipper to the swashplate.

14. The hydrostatic power unit of claim 13 wherein the swashplate further includes a lubrication passage therein extending from a bottom surface of the swashplate to intersect the enlarged diameter portion of the socket.

15. The hydrostatic power unit of claim 13 wherein the slipper is undercut rearwardly of the major diameter so as to allow some angular freedom of movement of the slipper with respect to the swashplates when the swashplate is pivoted.

16. The hydrostatic power unit of claim 13 comprising a bias piston operatively opposing the servo piston, a second socket formed in the swashplate on an opposite side of the tilt axis from the first socket, and a second slipper pivotally secured to the swashplate in a manner identical to the first slipper and having a pad end slidably contacting the bias piston.

17. A variable displacement hydrostatic power unit comprising:

a housing;

a swashplate pivotally mounted in the housing;

an elongated male slipper having a pad end opposite a substantially spherical shaped ball end having a transverse major diameter;

a substantially cylindrical socket formed in the swashplate;

a substantially cylindrical sleeve of malleable metal having forward and rear portions and a partially spherical cavity formed in the forward portion to pivotally receive the major diameter of the ball end of the slipper; the sleeve having a normally outwardly and rearwardly ramped skirt portion on the rear portion of the sleeve bent inwardly towards the ball end rearwardly of the major diameter and having an outer surface in press fit relation in the socket to retain the sleeve in the socket and to retain the ball end of the slipper in the sleeve.

18. The hydrostatic power unit of claim 17 wherein the slipper is undercut rearwardly of the major diameter so as to allow some angular freedom of movement of the slipper with respect to the swashplate when the swashplate is pivoted.

19. A method of forming a pivotal swashplate assembly for a variable displacement hydraulic unit, the method comprising the steps of:

forming a socket having a given diameter in the swashplate offset from a pivot axis thereof;

placing a sleeve having a main outer diameter less than the given diameter of the socket at an entrance of the socket, the sleeve having a partially spherical cavity therein and a malleable ramped skirt portion extending rearwardly and outwardly from the main outer diameter to a skirt outer diameter that is greater than the given diameter;

inserting a ball end of a male slipper servo pad into the cavity of the sleeve to form a loosely assembled sleeve and slipper subassembly;

applying a force on the subassembly in an axial direction to press fit the sleeve into the socket in the swashplate and in the same step bending or deforming the ramped skirt inwardly to crimp the ramped skirt around the ball end of the slipper servo pad and pivotally secure the slipper servo pad to the swashplate.

20. The method of claim 19 wherein the force is applied in an axial direction on the male slipper servo pad.

* * * * *